US009358446B2

(12) United States Patent
Thomas et al.

(10) Patent No.: US 9,358,446 B2
(45) Date of Patent: Jun. 7, 2016

(54) ADJUSTABLE CONNECTING ELEMENT WITH CLEARANCE COMPENSATION FOR A GLIDING BOARD

(71) Applicant: SKIS ROSSIGNOL, Saint-Jean-de-Moirans (FR)

(72) Inventors: Gérard Thomas, Urzy (FR); Yohann Francois, Voiron (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 0 days.

(21) Appl. No.: 14/661,889

(22) Filed: Mar. 18, 2015

(65) Prior Publication Data

US 2015/0265905 A1 Sep. 24, 2015

(30) Foreign Application Priority Data

Mar. 19, 2014 (FR) ..... 14 52268

(51) Int. Cl.
*A63C 9/00* (2012.01)
*A63C 9/24* (2012.01)

(52) U.S. Cl.
CPC . *A63C 9/005* (2013.01); *A63C 9/24* (2013.01); *A63C 2009/008* (2013.01)

(58) Field of Classification Search
CPC ..... A63C 9/005; A63C 9/008; A63C 9/22
See application file for complete search history.

(56) References Cited

U.S. PATENT DOCUMENTS 3,921,997 A * 11/1975 Begey ..... A63C 9/005 280/623
4,185,852 A * 1/1980 Himmetsberger ..... A63C 9/005 280/618
4,345,776 A * 8/1982 Salomon ..... A63C 9/005 280/626
4,593,928 A * 6/1986 Scheck ..... A63C 9/08557 280/625
4,974,869 A * 12/1990 Muhlberger ..... A63C 9/08521 280/625

(Continued)

FOREIGN PATENT DOCUMENTS

AT 500309 A1 11/2005
EP 2147704 A1 1/2010

(Continued)

OTHER PUBLICATIONS

French Search Report and Written Opinion dated Nov. 26, 2014, issued in corresponding French Patent Application No. FR 1452268; with English translation and machine translation (12 pages).

(Continued)

*Primary Examiner* — Jeffrey J Restifo
*Assistant Examiner* — Erez Gurari
(74) *Attorney, Agent, or Firm* — Westerman, Hattori, Daniels & Adrian, LLP

(57) ABSTRACT

An adjustable connecting element (10) of a device for fixing a shoe to a gliding board, capable of a mobile connection with a second element (50) to enable movement thereof for adjusting the position of a shoe fixing device on the gliding board, characterized in that it includes a rod (12) comprising a locking element (13) capable of fixing the connecting element on the second element (50) and in that it includes at least one clearance compensation component (25), the rod (12) comprising an actuating element (15) cooperating with at least one clearance compensation component (25), so as to reduce or to eliminate remaining clearance when fixing the connecting element by means of the locking element (13).

21 Claims, 8 Drawing Sheets

(56) References Cited

U.S. PATENT DOCUMENTS

| | | | | |
|---|---|---|---|---|
| 5,222,756 | A * | 6/1993 | Gorza | A63C 9/005 280/616 |
| 2007/0145720 | A1 * | 6/2007 | Resch | A63C 7/1033 280/607 |

FOREIGN PATENT DOCUMENTS

| | | | |
|---|---|---|---|
| FR | 2270912 | A1 | 12/1975 |
| FR | 2340749 | A1 | 9/1977 |
| FR | 2823681 | A1 | 10/2002 |
| FR | 2 997 021 | | 4/2014 |

OTHER PUBLICATIONS

European Search Report and Written Opinion dated Jun. 15, 2015, issued in counterpart European application No. EP 15159898; with English partial translation and partial machine translation (17 pages).

* cited by examiner

ADJUSTABLE CONNECTING ELEMENT WITH CLEARANCE COMPENSATION FOR A GLIDING BOARD

The invention concerns an adjustable element for connecting to a gliding board a boot binding device for gliding board, for example a front binding device known as a "toe-piece" or a rear binding device known as a "heel-piece" of a ski binding or a base of a device for fixing a shoe to a surfboard or "snowboard". It also concerns a boot binding as such that is connected to such an adjustable element and a gliding board as such.

In the prior art, various devices enable adjustment of the longitudinal position of a toe-piece or a heel-piece of a ski binding with the aim of adapting the fixing device to ski boots of different sizes. One common solution is based on the one hand on a first element positioned on the ski, including guide rails and a toothed part, and on the other hand on a heel-piece or a toe-piece the base of which is provided with guide rails and a toothed part that are complementary. The two complementary toothed parts can be interleaved and block longitudinal movement of the heel-piece or the toe-piece in the rails in a longitudinal fixing position for skiing. Means for releasing these toothed parts allow movement of the heel-piece or toe-piece to adjust its position.

However, all existing solutions have some of the following disadvantages:

- they necessitate a tool such as a screwdriver for releasing the toothed parts. This tool must be inserted through an opening and held in position during the adjustment. In this case, the solutions are not user friendly and not well suited to rapid adjustments under all conditions, for example on ski slopes where the specific tool is not always available; and/or
- they are complex, because based either on a large number of components or on elements that are complex to manufacture or to assemble: this renders them costly, less reliable, not very user friendly and incompatible with existing standard toe-pieces or heel-pieces; and/or
- they are sometimes of relatively poor appearance because mechanical elements of relatively poor appearance are visible; and/or
- they are bulky and increase the overall volume of the accessory to be mounted on the gliding board; and/or
- they are not reliable, meaning that they can lead to accidental loss of adjustment of the position of the accessory during use, which is dangerous because it can lead to the skier falling; and/or
- they can be subject to clearance that compromises their performance and their safety.

The document EP2147704 describes a solution requiring no tools and enabling a good many of the disadvantages referred to above to be alleviated.

However, there still exists a requirement for an improved, simple, user-friendly, safe and reliable solution for the adjustable connection of a shoe fixing device to a gliding board.

A general object of the present invention is therefore to propose a solution for the adjustable connection of a boot binding device to a gliding board that is free of some or all of the disadvantages of the prior art.

To be more precise, a main object of the invention is to propose such a connection solution enabling fixing free of play (clearance).

In a complementary way, the invention aims to achieve some or all of the objects consisting in proposing such a connection solution whereby carrying out the adjustment is user friendly and easy to carry out under all conditions and that is of relatively low cost, relatively small bulk and of good appearance.

To this end, the invention provides an adjustable element for connecting to a gliding board a device for fixing a shoe, capable of a mobile connection with a second element to enable movement thereof for the adjustment of the position of a shoe fixing device on the gliding board, characterized in that it includes a rod comprising a locking element capable of fixing the connecting element to a second element and in that it includes at least one clearance compensation component, the rod comprising an actuating element cooperating with at least one clearance compensation component, so as to reduce or to eliminate remaining clearance when fixing the connecting element by means of the locking element.

In accordance with one advantageous embodiment, the connecting element comprises at least one clearance compensation component separate from the locking element.

Moreover, the rod may comprise at least one actuating element and one locking element disposed at two separate positions along the axis of the rod.

The connecting element can occupy the following two configurations:

- a locking configuration in which the locking element occupies a fixing position capable of locking any movement of the connecting element in an adjustment direction, and in which the at least one actuating element acts on at least one clearance compensation component so as to be able to hold it pressed onto a stop to reduce any rolling and/or twisting movement of the connecting element;
- an adjustment configuration in which the locking element occupies a folded position and in which the actuating element releases the clearance compensation component that is no longer able to come to bear against said stop, so that the connecting element is capable of movement in an adjustment direction.

The connecting element may comprise a lever for actuating the rod, the lever occupying a closed position in a locking configuration and an open position in an adjustment configuration.

The rod may extend in the longitudinal direction, is fastened to the lever and/or simply connected to the lever, is mobile in rotation about its axis, so that actuating the lever generates rotation of the rod.

An actuating element of the rod may comprise a cam surface for acting on at least one clearance compensation component on actuating the rod.

The rod may take the form of a cylindrical rod mobile in rotation and an actuating element of the rod may be formed by a peripheral surface of the rod that is not symmetrical with respect to its rotation axis.

At least one clearance compensation component may comprise a bearing surface mobile in translation in a transverse direction able to fulfill a clearance compensation function by exerting a bearing force having a component in the transverse direction on a complementary surface of a second element forming a stop.

The connecting element may comprise at least two clearance compensation components capable of exerting a bearing force in two opposite directions.

A clearance compensation component may comprise a notch in which is housed an element for actuating the rod.

The connecting element may comprise at least two identical clearance compensation components distributed in accordance with two opposite orientations on either side of the median plane of the connecting element and mobile simultaneously relative to that plane in two opposite directions.

The rod may be positioned between two clearance compensation components and comprise two actuating elements located in two notches of respective clearance compensation components to act simultaneously on each of the two clearance compensation components on actuating the rod.

The locking element of the rod may comprise notches on a peripheral part of greater diameter than the rod.

The invention also relates to a system for adjustable connection to a gliding board of a boot binding device, characterized in that it comprises a connecting element as described above provided with guide slides and a second element comprising slides in which the slides of the connecting element are mounted to allow relative longitudinal movement of the two elements in an adjustment configuration.

The second element may comprise a locking element that co-operates with the locking element of the connecting element in a locking configuration of the connection system and at least one bearing surface that forms a stop of at least one clearance compensation component in a locking configuration of the connection system.

A bearing surface of the second element is part of a slide of the second element.

The invention further relates to a device for fixing a shoe to a gliding board, notably a toe-piece for receiving the anterior part of a ski boot, characterized in that it is connected to a connecting element as described above.

The invention further relates to a gliding board characterized in that it comprises such a boot binding device.

These objects, features and advantages of the present invention are explained in detail in the following description of one particular embodiment given by way of nonlimiting example with reference to the appended figures, in which.

Figure 1:
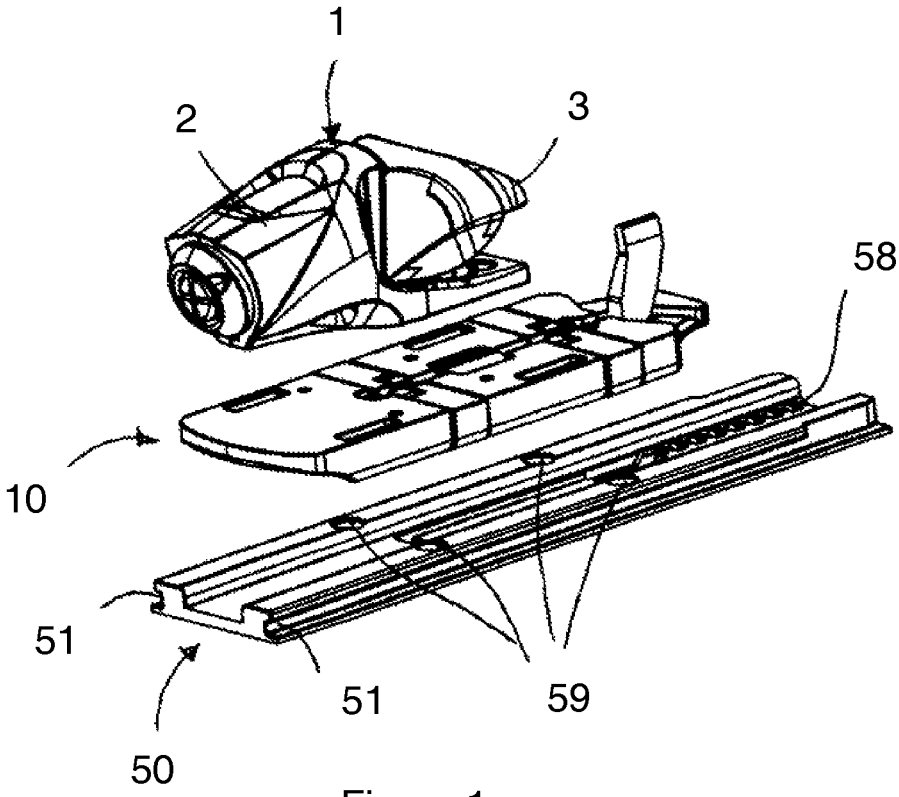
FIG. 1 represents an exploded perspective view of a toe-piece of a ski binding and a system in accordance with one embodiment of the invention for connecting the toe-piece to a ski.
Figure 2:
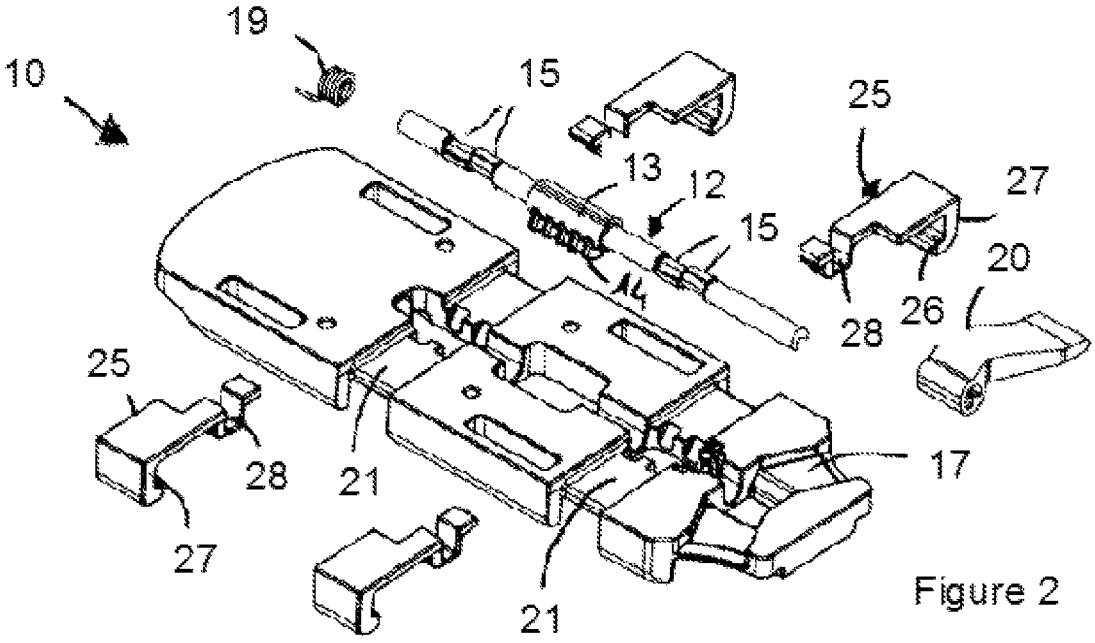
FIG. 2 represents an exploded perspective view from above of a connecting element in accordance with this embodiment of the invention for connecting a toe-piece of a ski binding to a ski.
Figure 3:
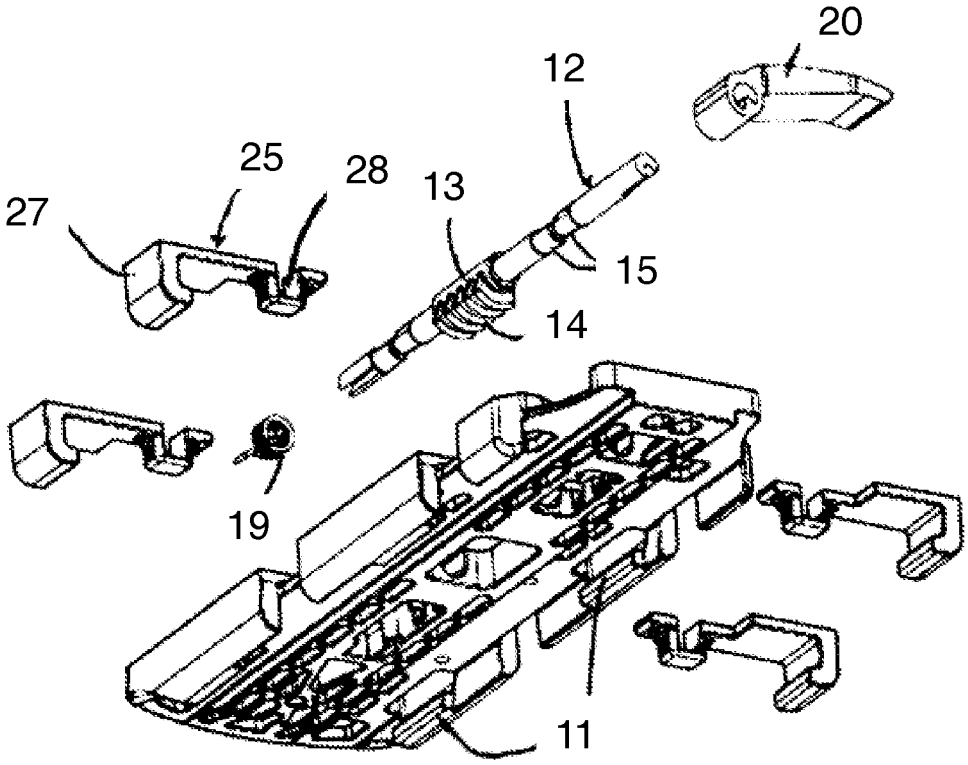
FIG. 3 represents an exploded perspective view from below of a connecting element in accordance with this embodiment of the invention for connecting a toe-piece of a ski binding to a ski.
Figure 4:
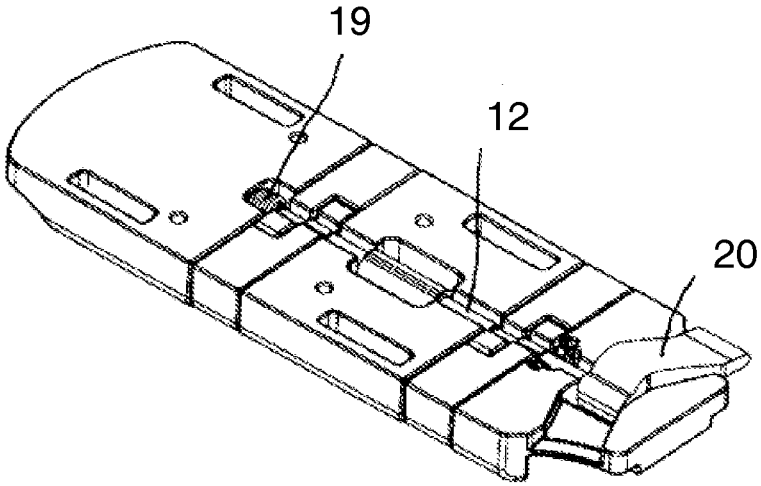
FIG. 4 represents an exploded perspective view from above of a connecting element in accordance with this embodiment of the invention of a footwear binding on a ski in a locking configuration.
Figure 5:
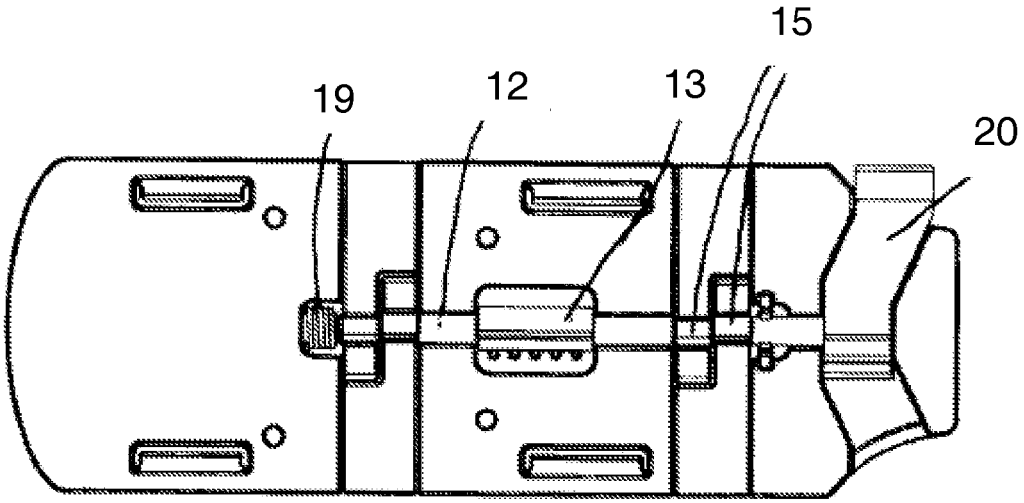
FIG. 5 represents a view from above of the connecting element in accordance with this embodiment of the invention for connecting a toe-piece of a ski binding to a ski in a locking configuration.
Figure 6:
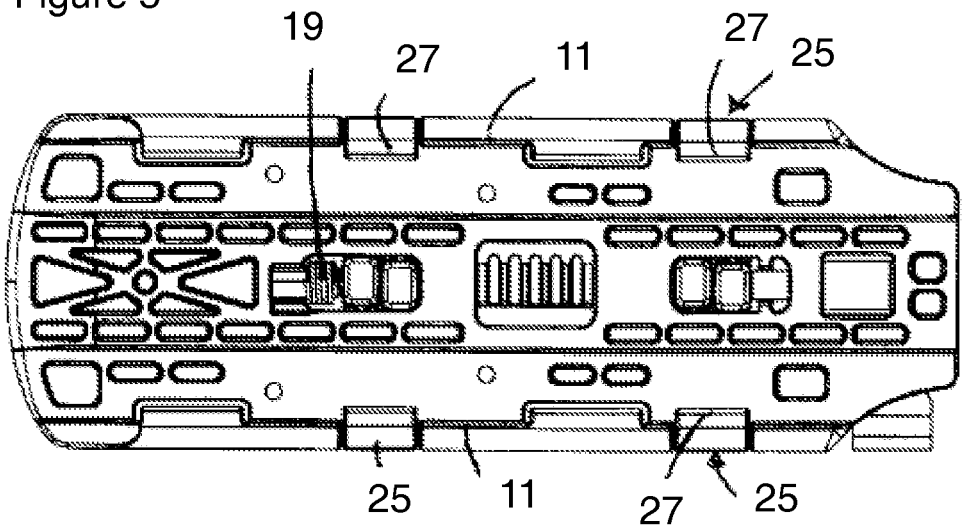
FIG. 6 represents a view from below of the connecting element in accordance with this embodiment of the invention for connecting a toe-piece of a ski binding to a ski in a locking configuration.
Figure 7:
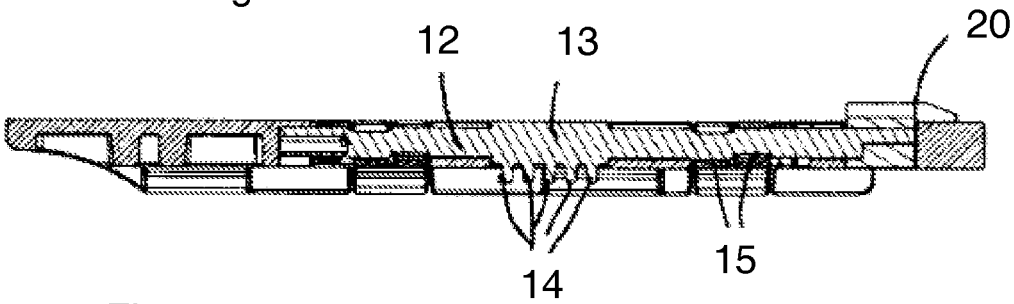
FIG. 7 represents a side view in section on a vertical longitudinal median plane of the connecting element in accordance with this embodiment of the invention for connecting a toe-piece of a ski binding to a ski in a locking configuration.

To facilitate the following description, the longitudinal direction is defined by convention as the direction in the sense of the adjustment of a toe-piece of a ski binding, that is to say also in the longitudinal direction of the ski, from the rear toward the front and the transverse direction is the horizontal direction perpendicular to the longitudinal direction. The vertical direction is perpendicular to the other two directions and oriented upward, perpendicularly to the surface of the gliding board, not represented.

The invention will be illustrated in the context of the fixing that is adjustable in the longitudinal direction of a toe-piece of a ski binding. It could nevertheless be implemented for fixing the heel-piece of the ski binding, or more generally for the adjustable fixing of any footwear fixing device to any gliding board, including snowboards, for example. Accordingly, it may be implemented for the adjustment of a footwear binding device in an adjustment direction other than the longitudinal direction, for example a transverse direction in the example of a base of a device for fixing footwear to a snowboard.

In accordance with this embodiment of the invention, a system for connecting a toe-piece 1 to a ski rests on an upper connecting element 10, which takes the form of a base of the toe-piece 1, and on a lower second element 50, in the form of a lower base, intended to be fixed to the surface of a ski, not represented. The toe-piece comprises a main upper body 2 comprising in its rear part two jaws 3 able to grip the front part of a ski boot, in known manner. Note that the connecting element 10 is separate from the toe-piece 1 here but could instead be integrated into the toe-piece or a body of the toe-piece, forming a non-dissociable element. Similarly, the lower second element 50 is separate from the ski in this embodiment, but could alternatively be integrated directly into the structure of the ski.

As is apparent in FIG. 1, and then in FIGS. 8 to 11, the second element 50 of the system for connecting the toe-piece 1 to a ski comprises longitudinal slides 51 arranged at its lateral edges, the cross section of which has a U-shape on its side oriented outward in this embodiment. Other shapes of slides can naturally be envisaged. It further comprises a locking element 58 in the form of a longitudinal part incorporating notches formed within a substantially horizontal metal plate, comprising a plurality of notches extending in the longitudinal direction to enable the longitudinal adjustment of the toe-piece by choosing the detent(s), each detent taking the form of a transverse slot. Finally, this lower base comprises openings 59 for fixing it to the surface of a ski by means of a plurality of screws passing through these openings 59. Alternatively, any other locking means may be envisaged.

The connecting element 10 is more particularly represented by FIGS. 2 to 7. It comprises firstly lateral slides 11 of corresponding shape to the slides 51 of the lower base, to enable its retention in the vertical direction and its longitudinal guidance relative to the lower base and therefore relative to the ski, for the longitudinal adjustment of the position of the toe-piece 1. It further comprises a lever 20 connected to an adjustment element extending longitudinally in its central part, taking the form of a longitudinal rod, referred to as the rod 12. The rod is substantially tubular. It has a substantially cylindrical exterior surface, with the exception of a few functional areas described hereinafter. It is movable in rotation about a longitudinal axis 40 by means of a lever 20 disposed toward its rear part and fastened to the rod. A return spring 19 is arranged toward the front end of the rod 12 so as to apply to the rod a return moment toward the closed position of the lever. The rod 12 comprises toward its central part a locking element 13 taking the form of an area of greater diameter of the rod in which are arranged a plurality of notches 14 adapted to cooperate or not with the longitudinal part of the lower base incorporating the notches. These two locking elements 13, 58 therefore form a locking device in the longitudinal (adjustment) direction, by virtue of notches in this embodiment of the invention, which enables the adjustable fixing of the toe-piece as described in detail hereinafter. This fixing function can naturally be replaced by any equivalent mechanism, such as toothed parts. The rod and/or the notches of the locking elements 13, 58 are advantageously made of metal, or alternatively of fiber-reinforced plastic.

Figure 14:
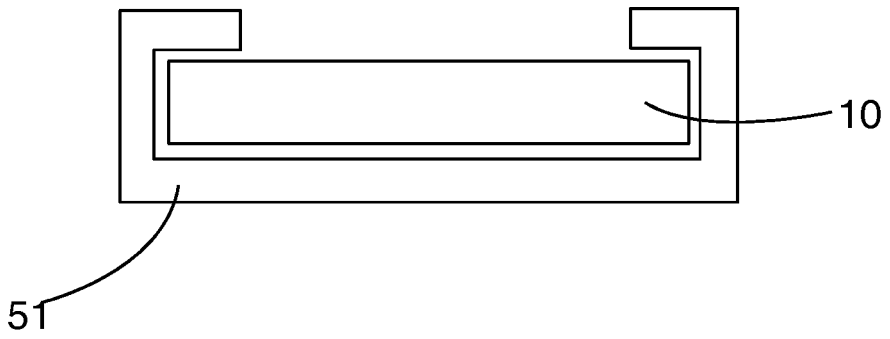
FIG. 14 represents a simplified view of a connecting element in accordance with a variant embodiment cooperating with a second element having a different slide geometry.
Figure 15:
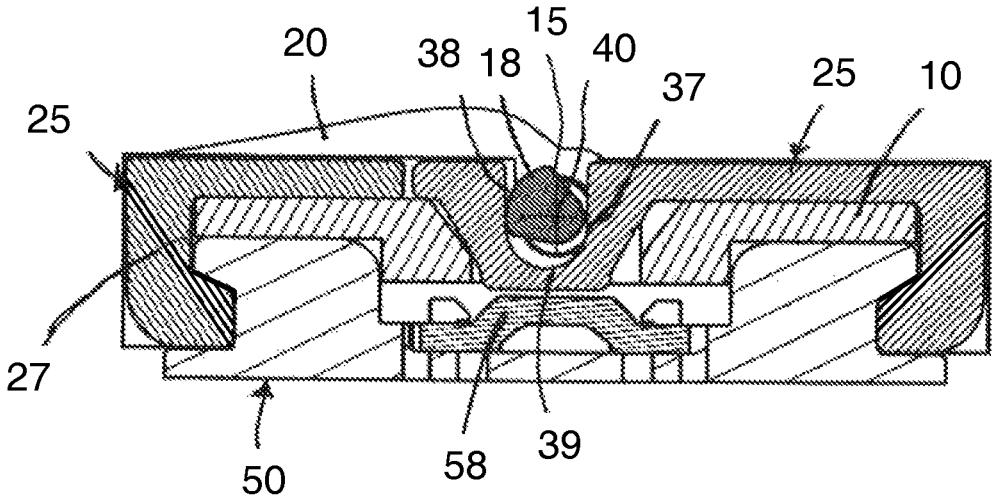
FIG. 15 represents a view in cross section at the level of a clearance compensation component of the system in accordance with a variant embodiment of the invention for connecting a toe-piece of a ski binding to a ski in a locking configuration.
Figure 16:
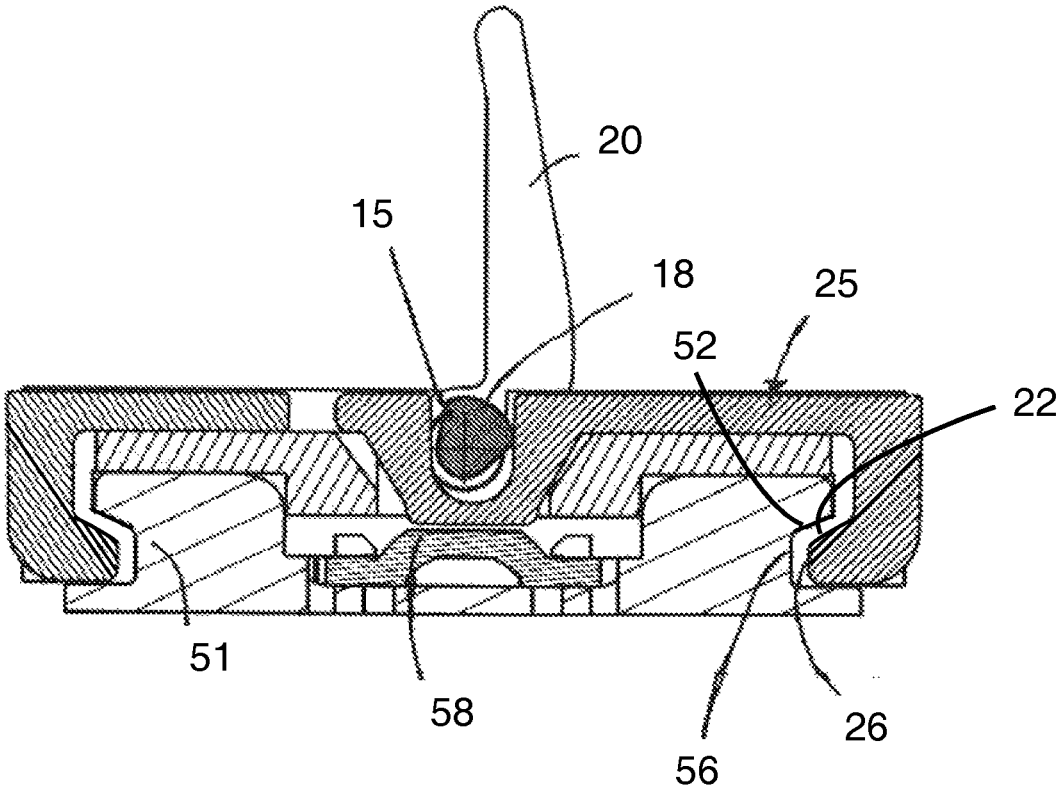
FIG. 16 represents a view in cross section at the level of a clearance compensation component of the system in accordance with this variant embodiment of the invention for connecting a toe-piece of a ski binding to a ski in a longitudinal adjustment configuration.

Thus FIG. 14 shows diagrammatically a variant embodiment in which the slides 51 of the second element 50 are oriented inward and therefore receive the connecting element 10 the lateral parts of which forming slides 11 are simplified. In these embodiments, U-shaped representations are chosen for the slides, in which the retaining and guidance functions are implemented with vertical and/or horizontal surfaces. Nevertheless, in accordance with another embodiment represented by FIGS. 15 and 16, the corresponding slides 11, 51 could comprise a skewed surface (respectively 22, 52), neither horizontal, nor vertical, to improve their cooperation and their efficacy in the clearance compensation function.

The rod 12 further comprises four actuating elements 15 arranged directly at the circumference of the rod, the diameter of which is locally modified to obtain non-symmetrical parts around the axis 40 of the rod 20, which form rounded surfaces 18 acting as cam surfaces. These actuating elements 15 cooperate with clearance compensation components 25 in a manner described in detail hereinafter. Each clearance compensation component 25 is mounted to be mobile in transverse translation inside the connecting element 10, in housings 21, and comprises a lateral edge 27 having a slide shape, with a U-section, that is locally substituted for the slide 11 of the connecting element 10. Each clearance compensation component further comprises a notch 28 cooperating with the rod 12 to move it transversely and to implement the clearance compensation function. Note that the rod 12 comprises at least one actuating element 15 and one locking element 13 disposed at two different positions along its axis. Moreover, the connecting element comprises at least one clearance compensation component 25 separate from the locking element 13, distinct from the locking element 13.

The operation of this system for connecting a toe-piece 1 to a ski is explained next with reference to FIGS. 8 to 11.

Figure 8:
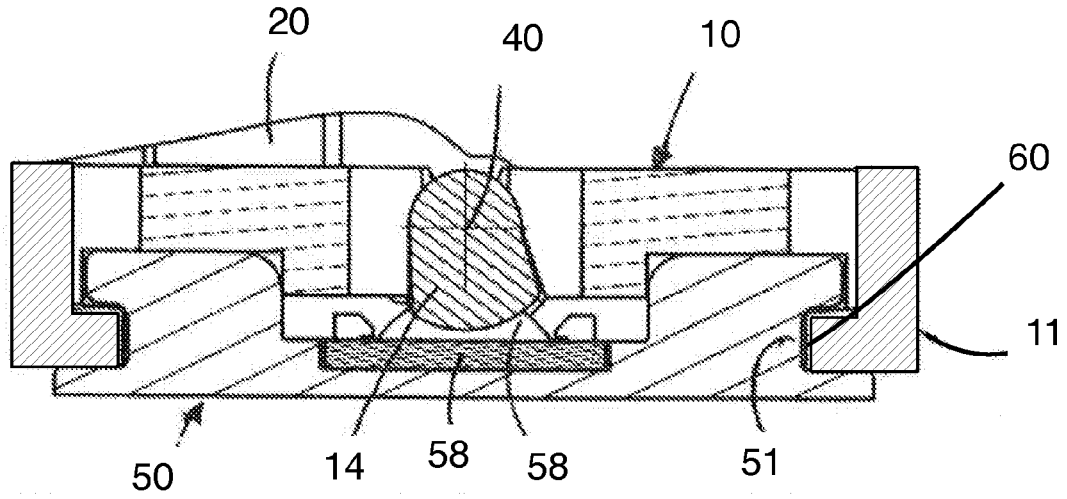
FIG. 8 represents a view in cross section at the level of a detent element of the system in accordance with this embodiment of the invention for connecting a toe-piece of a ski binding to a ski in a locking configuration.
Figure 9:
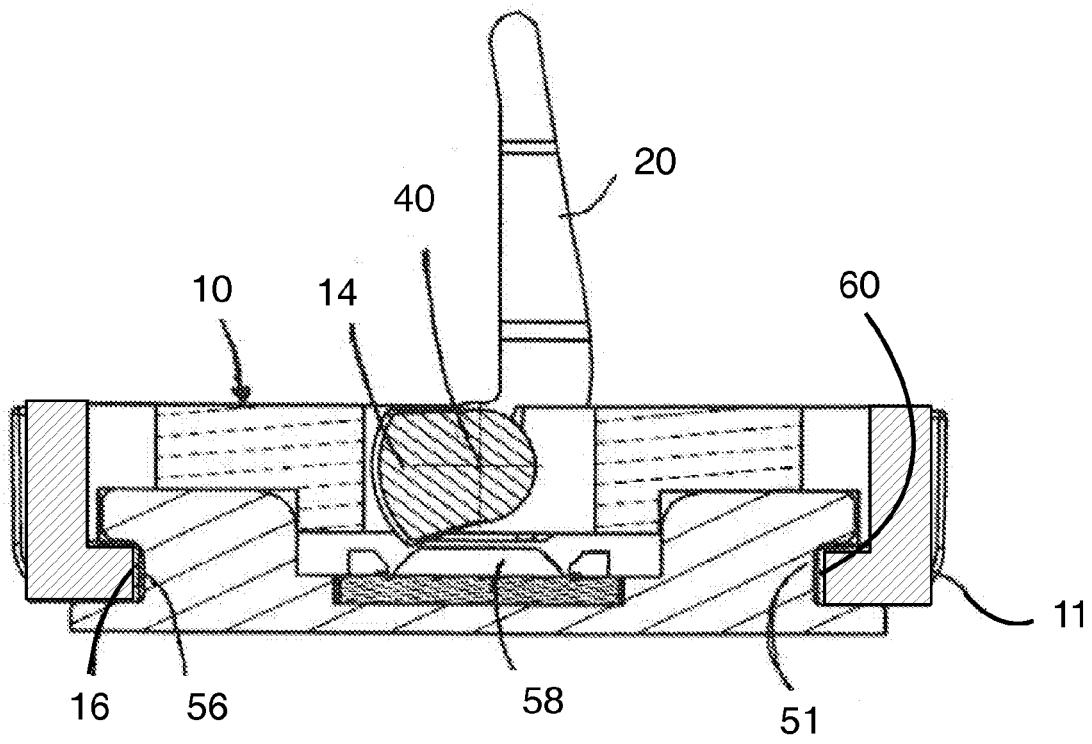
FIG. 9 represents a view in cross section at the level of a detent element of the system in accordance with this embodiment of the invention for connecting a toe-piece of a ski binding to a ski in a longitudinal adjustment configuration.

FIG. 8 shows the connection system in section on a vertical transverse plane at the level of a detent 14 of the locking element 13 of the rod 12. The lever 20 is in the closed position, abutted against a surface 17 of the connecting element 10, arranged in a housing formed within the thickness in the rear part of the connecting element, which enables it to be partially retracted, to prevent it impeding the positioning of a boot when skiing. In this closed position of the lever 20, each detent 14 occupies a low position, in which at least one detent cooperates with the complementary notches of the locking element 58 of the lower base. In this locking configuration, the notches 14 therefore prevent any longitudinal movement of the connecting element 10 relative to the lower second element 50, ensuring fixing of the toe-piece 1 relative to a ski.

When the lever 20 is actuated manually, by rotating it upward, about its longitudinal rotation axis corresponding to the axis 40 of the rod 12, it drives the rotation of the rod about its axis, until the notches 14 escape from the locking element 58 of the lower base. The geometry of the notches 14, which extend over an angle of approximately 45° around the rod, is such that they escape for a rotation of approximately 90° of the lever 20. In the open configuration of the lever, the locking element 13 is therefore in a folded position and the connecting element 10 therefore becomes mobile relative to the lower base 50, enabling its longitudinal movement, guided by the cooperation of the respective slides 11, 51 of the two lower and upper elements of the connection system. The latter is then in the adjustment configuration.

Note that, to render this adjustment user friendly, despite the unfavorable conditions encountered on a ski slope, because of the presence of snow, water, dirt, cold, etc., a clearance 60 greater than or equal to 0.2 mm, and even up to 0.4 mm inclusive, is provided between the respective slides 11, 51 of the upper and lower bases. Such clearance is notably important between the facing vertical surfaces 16, 56 of the respective slides 11, 51. This clearance makes it possible to guarantee proper relative sliding of the two element without jamming at the level of the slides despite the unfavorable circumstances mentioned above. On the other hand, this clearance has the disadvantage that in the locking configuration of the connection system there is a risk of the connecting element 10 retaining slight mobility, notably in rotation about a vertical axis, or even about a transverse axis, that is to say in torsion or rolling. Such movements are perceptible by the skier, for example in the form of vibrations, giving them an impression of lack of safety, and even possibly degrading their performance on the snow.

To alleviate this disadvantage, the system for connecting a toe-piece 1 to a ski further comprises a clearance compensation device, actuated by means of the same lever 20, in a manner coordinated with the locking mechanism explained above. For this, actuating elements 15 are disposed around the rod 12, as seen particularly in FIGS. 10 and 11 in cross section at the level of these actuating elements 15, and on the larger scale FIG. 13. They have a geometry that is not symmetrical about the rotation axis 40 of the rod 12, forming a cam. They are fastened to the rod and movable in rotation with the rod 12 by means of the lever 20. They are accommodated inside a U-shaped housing formed by the slot (or notch) 28 of a clearance compensation component 25, disposed at the level of the central part of the connecting element 10. This slot 28 therefore comprises two substantially vertical surfaces, a first surface 37 disposed on the right in FIG. 10 and a second surface 38 disposed on the left, connected by a substantially horizontal surface 39 that extends under the rod 12. By virtue of this approach, the rod 12 ensures retention of the clearance compensation component 25, which cannot escape upward. The clearance compensation component 25 comprises a lateral edge 27 that forms a slide, intended to cooperate with the slide 51 of the lower base. To this end, it has a U-shape lying on its side, the lower extremity of which is accommodated inside said slide 51. As mentioned above, this slide shape could be different.

Figure 10:
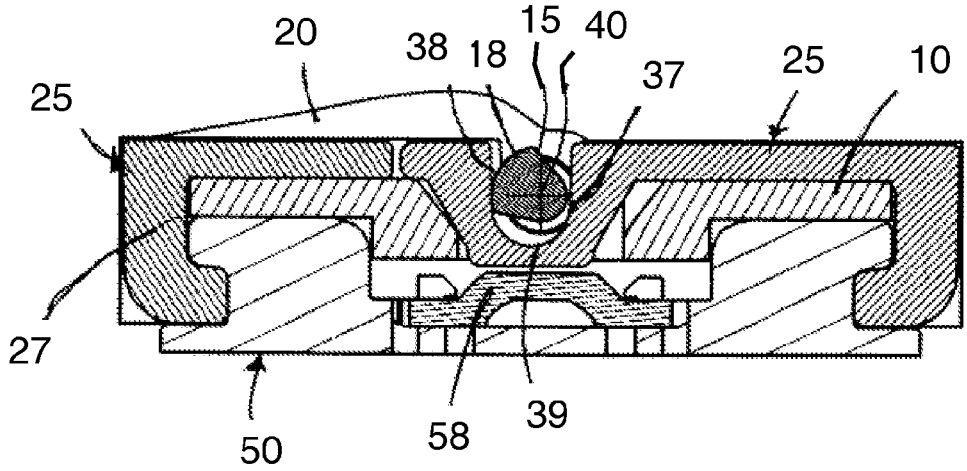
FIG. 10 represents a view in cross section at the level of a clearance compensation component of the system in accordance with this embodiment of the invention for connecting a toe-piece of a ski binding to a ski in a locking configuration.

FIG. 10 shows the connection system in the locking configuration, the lever 20 occupying its closed position. The rounded surface 18 at the circumference of the actuation component 15 is bearing on the left-hand vertical surface 38 of the clearance compensation component 25 (that on the right in FIG. 10), exerting on the latter a transverse force tending to move this clearance compensation component 25 in translation inward, therefore ensuring its retention in a first stable clearance compensation position, in which a substantially vertical and longitudinal surface 26 of its lateral edge 27 comes to abut on the corresponding vertical and longitudinal bearing surface 56 situated at the bottom of the slide 51 of the lower base. This bearing force is predefined by the shape of the actuation component 15 so as to guarantee the clearance compensation function. Note that in this first position the surface 22, which is horizontal or alternatively inclined in the variant embodiment of FIGS. 14 and 15, from the top of the lateral edge 27 also preferably comes to bear on the corresponding top surface 52 of the slide 51.

Figure 11:
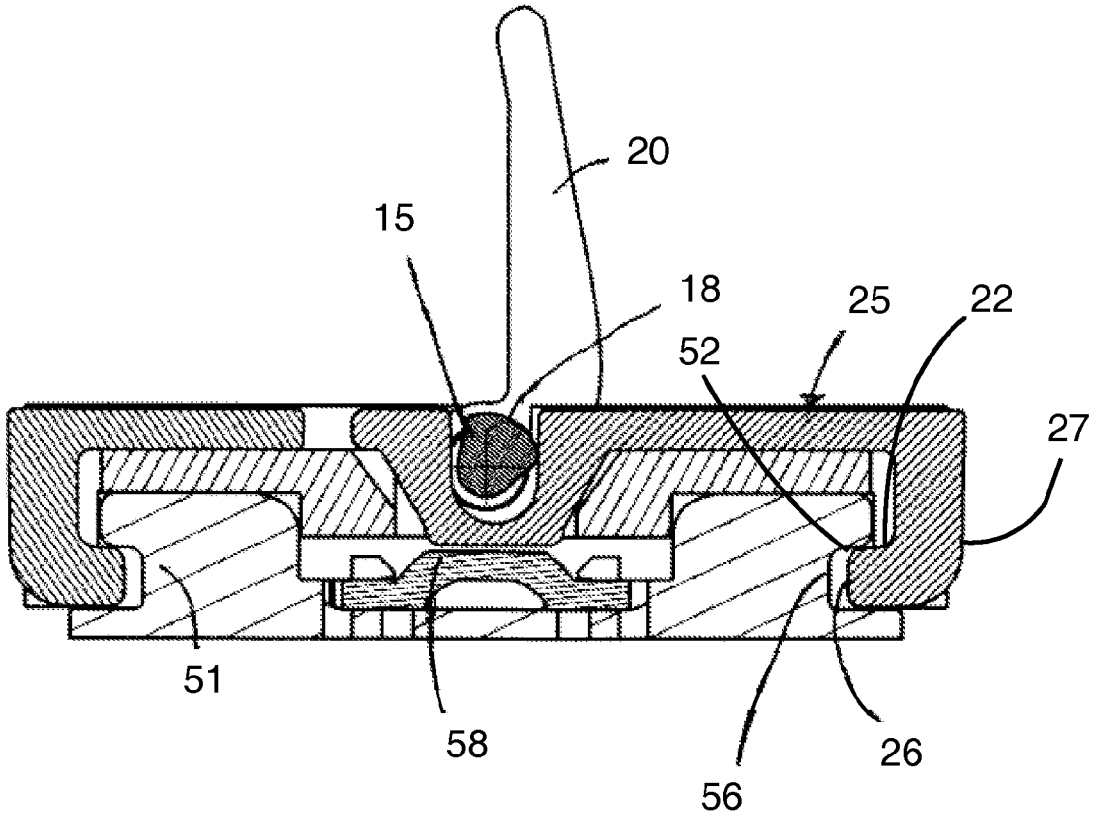
FIG. 11 represents a view in cross section at the level of a clearance compensation component of the system in accordance with this embodiment of the invention for connecting a toe-piece of a ski binding to a ski in a longitudinal adjustment configuration.
Figure 12:
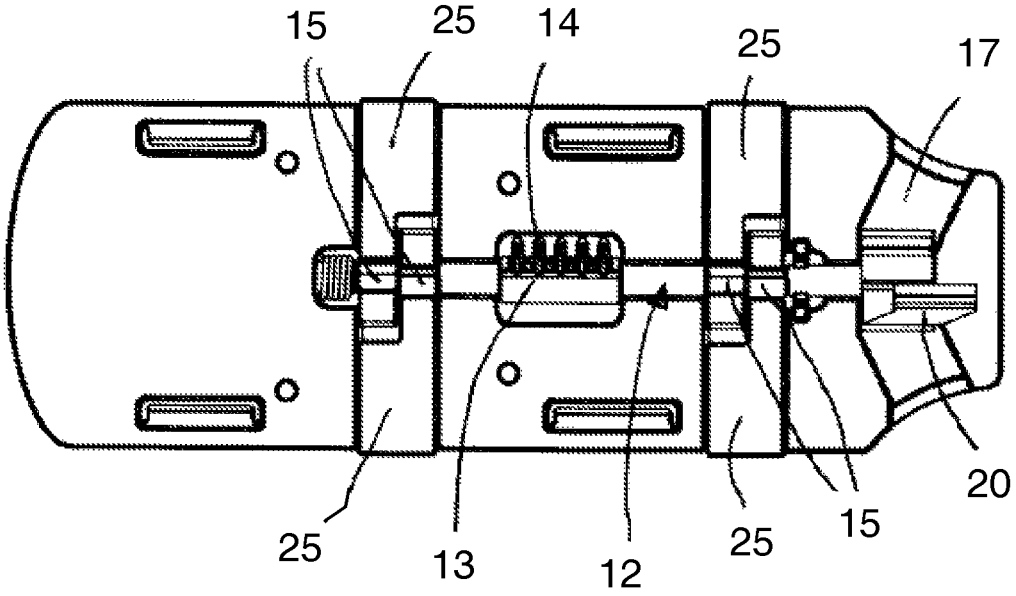
FIG. 12 represents a view from above of the element in accordance with this embodiment of the invention for connecting a toe-piece of a ski binding to a ski in a longitudinal adjustment configuration.
Figure 13:
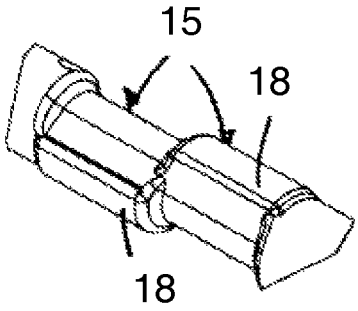
FIG. 13 represents an enlarged view of actuating elements of the rod of the element in accordance with this embodiment of the invention for connecting a toe-piece of a ski binding to a ski.

When the lever 20 is raised toward its open position to reach the adjustment configuration, represented in FIG. 11, the actuation component 15 on the rod 12, more particularly visible in FIG. 13, likewise effects a rotation so that its rounded peripheral surface 18 comes to exert a force on the right-hand vertical surface 37 of the clearance compensation component 25, leading to its outward transverse movement in translation toward a second stable position, leading to the two surfaces 26, 56 moving away from each other inside the slide 51. Accordingly, in this adjustment configuration, the clearance compensation components 25 also release the connecting element 10, which acquires good longitudinal mobility. FIG. 12 also shows the connecting element 10 as seen from above in the adjustment configuration.

The lateral stroke of a clearance compensation component 25 is adjusted by the geometry of the actuation components 15 and the slot 28 of each clearance compensation component. This stroke is preferably greater than or equal to 1 mm, even greater than or equal to 1.5 mm, for example approximately 2 mm, and less than or equal to 4 mm, even 2.5 mm. The movement of the clearance compensation components 25 is therefore achieved by the cooperation of two complementary surfaces, including the peripheral surface 18 of an actuation component, forming a cam. Naturally, such actuation could alternatively be attained by a shape other than a cam, and more generally by any other mechanism connecting the rod 12 to the clearance compensation component 25. Furthermore, a return spring could act on a clearance compensation component to return it automatically into one of the stable positions on actuating the rod, notably the release second stable position for adjusting the position of the connecting element 10.

On closing the lever 20 to return to the locking configuration of the connection system, the clearance compensation component first moves freely inward in transverse translation over a first stroke, before coming into contact with the bearing surface 56 at the bottom of the slide 51 of the lower element, when the lever still has approximately 45° to travel. Thereafter, over a second stroke corresponding to the end of rotation of the lever, the clearance compensation component 25 no longer moves, since it is already in the abutting position, but exerts an increasingly strong force on the bearing surface 56 of the slide.

In the chosen embodiment, four clearance compensation components 25 are provided, arranged as two pairs. Each pair comprises two facing clearance compensation components, the two notches of which are aligned in the longitudinal direction to receive an element for actuating the rod, which enables their movement in two opposite orientations on either side of the median plane of the connecting element, fulfilling a complementary and simultaneous clearance compensation function by bearing on two opposite surfaces, on each opposite lateral slide, exerting bearing forces of the same value in opposite transverse directions. By virtue of this substantially symmetrical construction, the two right-hand and left-hand clearance compensation components 25 have exactly the same geometry and can easily be manufactured at optimum cost, for example by injection molding plastic using a single injection mold. These clearance compensation components could for example be formed of charged polyamide, or even any charged plastic material. Naturally, any other number of clearance compensation components may be provided, comprising at least one, and preferably an even number to exert equivalent bearing forces on each lateral side of the connecting element. The fact of using four of them, two at the front and two at the rear, forms an optimum clearance compensation solution.

In the embodiment described, the clearance compensation function is fulfilled by transverse bearing engagement by way of two surfaces 26, 56 substantially parallel to a longitudinal vertical plane. This bearing engagement could instead be effected in a vertical direction, on a horizontal surface, or on a combination of these two solutions on an inclined surface.

Moreover, in the embodiment shown, bearing surfaces of the clearance compensation components moreover have the advantage of being very far apart when they act at the level of surfaces toward the lateral edges: this ensures very high performance in terms of clearance compensation, particularly efficacious against clearance in rolling and twisting.

Alternatively, a clearance compensation component could fulfill its function with a movement different from that shown. A first relatively close variant would consist in providing bearing engagement on the interior face of a longitudinal vertical surface, and therefore in a direction opposite that of the above embodiment, oriented toward the exterior of the connecting element, a clearance compensation component therefore moving outward in a transverse direction to come into abutting relationship and eliminate the clearance and inward to release the two elements. Another variant embodiment could also easily be obtained by having the clearance compensation component(s) move over any stop other than the slide 51 serving to guide the adjustment of the longitudinal position of the elements 10, 50.

Moreover, the actuation of a clearance compensation component could be done in a manner different from that shown, by another mechanical connection between the rod and the component. A clearance compensation component could move with a movement different from a movement in translation, for example in rotation, or a combination of a rotation and a movement in translation. It could also be moved with a movement in translation in a direction other than that perpendicular to the rod, for example parallel to the rod.

Moreover, the two elements forming the connection system could have a different geometry. Certain components of one could be arranged on the other and vice versa. For example, the rod could be arranged on the lower element, like a clearance compensation component. The rod could also take a form other than the metal tubular rod of this embodiment. It could for example take the form of a flat rod. In accordance with another embodiment, the rod could extend along an axis transverse to the connecting element, the cam surface of an actuating element 15 then acting on a clearance compensation component 25 through a mechanism allowing its movement in transverse translation as in the previous embodiment, and therefore parallel to the rod.

Moreover, the invention has been illustrated on the basis of a lever but a clearance compensation and/or locking component could alternatively be actuated by a different kinematic system, from any holding member. Any actuator, in the form of a manually manipulatable holding member, whether fastened to the rod or not, might be suitable. This member may for example take the form of a member mobile in translation and not in rotation. In accordance with another variant embodiment, the actuation mentioned could be obtained with the aid of a tool, for example a screwdriver, through a notch formed for example at the rear end of the rod, in which case no holding member would be necessary.

It is necessary to distinguish clearly in these solutions the locking function and the clearance compensation function: these two functions are complementary and of a different nature. The locking function is obtained by complementary elements bearing notches or teeth or detents, that enable the placing on a gliding board of a footwear binding device that resists very high forces and is therefore suitable for skiing, for example. The clearance compensation function is generally present through an element offering a simple bearing engagement intended to reduce, and even to eliminate, unwanted movements of the connecting element, in particular relative to the slides in this embodiment. Apart from these structural differences, a second difference is functional. The locking, despite the presence of play (clearance), suffices to resist the loads exerted by a skier, for example. On the other hand, clearance compensation would be totally insufficient and of no utility on its own. By its very nature, it must be combined with a locking element. Accordingly, in accordance with the advantageous embodiment, the clearance compensation component(s) is/are separate from the locking element.

As mentioned above, one embodiment of the invention could be implemented on a snowboard for the adjustment of the base that receives the boot binding device. In such a case, this boot binding device retains the whole of the shoe and not only a front or rear part as on a ski, and the base is generally adjustable in the longitudinal and/or transverse direction relative to the gliding board.

The invention claimed is:

1. An adjustable connecting element of a device for fixing a shoe to a gliding board, the connecting element being capable of being slidably connected to a slide on a second element, so as to enable movement of the connecting element for adjusting a longitudinal position of a boot binding device on the gliding board, the adjustable connecting element comprising:

at least one clearance compensation component, and a rod mobile in rotation comprising:

a locking element capable of fixing the connecting element in a longitudinal position on the second element and an actuating element cooperating with the at least one clearance compensation component, so as to reduce or to eliminate a clearance remaining between the connecting element and the slide on the second element when fixing the connecting element by the locking element.

2. The connecting element as claimed in claim 1, wherein the at least one clearance compensation component is distinct from the locking element.

3. The connecting element as claimed in claim 1, wherein the rod comprises at least one actuating element and one locking element and wherein the actuating element and the one locking element are disposed at two distinct positions along an axis of the rod.

4. The connecting element as claimed in claim 1, wherein the connecting element is able to occupy a locking configuration or an adjustment configuration, wherein:

in the locking configuration, the locking element occupies a longitudinal position fixing position capable of locking any movement of the connecting element in an adjustment direction, and the at least one actuating element acts on the at least one clearance compensation component so as to be able to hold the clearance compensation component pressed onto a stop provided on the second element to reduce any rolling and/or twisting movement of the connecting element; and in the adjustment configuration, the locking element occupies a folded position and the actuating element releases the clearance compensation component such that the clearance compensation component is no longer able to come to bear against the stop, so that the connecting element is capable of movement in the adjustment direction.

5. The connecting element as claimed in claim 1, wherein the connecting element comprises a lever for actuating the rod, the lever occupying (i) a closed position when the connecting element is in a locking configuration and (ii) an open position when the connecting element is in an adjustment configuration, and wherein the rod extends in a longitudinal direction, is connected to the lever, and is mobile in rotation about an axis of the rod, so that actuating the lever rotates the rod.

6. The connecting element as claimed in claim 1, wherein the actuating element of the rod comprises a cam surface for acting on the at least one clearance compensation component upon actuating the rod.

7. The connecting element as claimed in claim 6, wherein the rod takes the form of a generally cylindrical rod mobile in rotation, and wherein the actuating element of the rod is formed by a peripheral surface of the rod that is not symmetrical with respect to a rotation axis of the rod.

8. The connecting element as claimed in claim 1, wherein the at least one clearance compensation component comprises a bearing surface mobile in translation in a transverse direction and to fulfill a clearance compensation function by exerting a bearing force having a component in the transverse direction on a complementary surface of the second element, the complementary surface of the second element forming a stop for the bearing surface.

9. The connecting element as claimed in claim 1, wherein the connecting element comprises at least two clearance compensation components capable of exerting a bearing force in two opposite directions.

10. The connecting element as claimed in claim 1, wherein the clearance compensation component comprises a slot in which the actuating element of the rod is housed.

11. The connecting element as claimed in claim 1, wherein the connecting element comprises at least two identical clearance compensation components distributed in two opposite orientations on either side of a median plane of the connecting element, wherein the at least two identical clearance compensation components are mobile simultaneously relative to the median plane in two opposite directions, and wherein the rod is positioned between the at least two identical clearance compensation components, comprises two actuating elements each located in a slot of the respective clearance compensation component to act simultaneously on each of the at least two identical clearance compensation components upon actuating the rod.

12. A system for adjustable connection of a boot binding device on a gliding board, comprising:

a connecting element as claimed in claim 1 and provided with guiding slides and a second element comprising slides, wherein the guiding slides of the connecting element are mounted in the slides of the second element to allow relative longitudinal movement of the connecting element and the second element when the connection system is in an adjustment configuration.

13. The adjustable connection system as claimed in claim 12, wherein the second element comprises:

a locking element that co-operates with the locking element of the connecting element when the connection system is in a locking configuration and at least one bearing surface that is part of a slide that forms a stop of the at least one clearance compensation component when the connection system is in a locking configuration in a locking configuration.

14. A boot binding device for gliding board, wherein the boot binding device is connected to a connecting element as claimed in claim 1.

15. A gliding board, comprising a boot binding device as claimed in claim 14.

16. The connecting element as claimed in claim 6, wherein the rod takes the form of a generally cylindrical rod mobile in rotation, and wherein the locking element of the rod comprises notches on a peripheral part of the locking element, the peripheral part of the locking element having a greater diameter than a diameter of the generally cylindrical rod.

17. The boot binding device as claimed in claim 14, wherein the boot binding device is adapted for adjusting a boot longitudinally on a gliding board.

18. The boot binding device as claimed in claim 14, wherein the boot binding device is adapted for adjusting a boot transversally on a gliding board.

19. A gliding board, comprising a boot binding device as claimed in claim 17.

20. A gliding board, comprising a boot binding device as claimed in claim 18.

21. The boot binding device as claimed in claim 14, wherein the boot binding device is a toe-piece for receiving an anterior part of a ski boot.

* * * * *